US006490749B1

(12) United States Patent
Morad

(10) Patent No.: US 6,490,749 B1
(45) Date of Patent: Dec. 10, 2002

(54) SPONGE MOP HEAD ASSEMBLY HAVING A UNIVERSAL ADAPTER FOR ADAPTING TO A WIDE VARIETY OF HANDLES

(75) Inventor: Fred I. Morad, Toluca Lake, CA (US)

(73) Assignee: Worldwide Integrated Resources, Inc., Commerce, CA (US)

( * ) Notice: Subject to any disclaimer, the term of this patent is extended or adjusted under 35 U.S.C. 154(b) by 74 days.

(21) Appl. No.: 09/851,680

(22) Filed: May 8, 2001

(51) Int. Cl.[7] ..... A47L 13/10; A47L 13/144
(52) U.S. Cl. ..... 15/145; 15/119.1
(58) Field of Search ..... 15/119.1, 121, 15/145

(56) References Cited

U.S. PATENT DOCUMENTS 115,040 A * 5/1871 Dunaway
4,908,901 A * 3/1990 Torres

* cited by examiner

*Primary Examiner*—Randall E. Chin
(74) *Attorney, Agent, or Firm*—Thomas I. Rozsa; Tony D. chen

(57) ABSTRACT

An universal adapter for adapting a sponge mop head assembly to a wide variety of conventional mop handles and includes a hollow body which slidably receives the sponge mop head assembly. The adapter has four different attachment mechanisms located on top of the hollow body for removably attaching four different types of mop handles. The first attachment mechanism of the adapter has two opposing bendable walls, wherein each bendable wall has an aperture for securely receiving a tongue and groove type mechanism of one of the plurality of mop handles. The second attachment mechanism of the adapter further has a central hook catch section for securely receiving a hook type mechanism of one of the plurality of mop handles. The third attachment mechanism of the adapter has a plurality of opposing engagement means for slidably receiving a slidable type mechanism of one of the plurality of mop handles. The fourth attachment mechanism of the adapter has a central threaded opening for securely receiving a threadable type mechanism of one of the plurality of mop handles.

12 Claims, 4 Drawing Sheets

36
38
42
40
34
40
40
38
36
26
28
40
40
50
14
28
32
30
32

36
42
40
40
34
40
36
26
40
40
28
50
14
28
32
30
32

SPONGE MOP HEAD ASSEMBLY HAVING A UNIVERSAL ADAPTER FOR ADAPTING TO A WIDE VARIETY OF HANDLES

BACKGROUND OF THE INVENTION

1. Field of the Invention

The present invention relates generally to the field of cleaning devices. More particularly, the present invention relates to the field of adapters for adapting a cleaning head assembly such as a sponge mop head assembly to a wide variety of handles.

2. Description of the Prior Art

Specifically, cleaning devices such as brooms, squeegees, dust mop, sweepers, swifters etc. are well known in the art. These cleaning devices are usually manufactured with handles on them. The problem with prior art cleaning devices is that when the handle breaks, the cleaning device is usually thrown away. Another problem with prior art cleaning devices is that when the cleaning head is worn out, the entire cleaning device is thrown away. A further problem with prior art cleaning devices is that the cleaning head is not universal, which means that the cleaning head is not adaptable to other types of handles.

It is desirable to provide a very efficient and also very effective design and construction of a sponge mop head assembly having a universal adapter for adapting to a wide variety of conventional handles. It is also desirable to provide a sponge mop head assembly having a universal adapter with the capability of rapidly changing to different type handles.

SUMMARY OF THE INVENTION

The present invention is a universal adapter for adapting a sponge mop head assembly to a wide variety of conventional mop handles.

The universal adapter includes a hollow body which slidably receives the sponge mop head assembly. The adapter has four different attachment mechanisms located on top of the hollow body for removably attaching four different types of mop handles. The first attachment mechanism of the adapter has two opposing bendable walls, wherein each bendable wall has an aperture for securely receiving a tongue and groove type mechanism of one of the plurality of mop handles. The second attachment mechanism of the adapter further has a central hook catch section for securely receiving a hook type mechanism of one of the plurality of mop handles. The third attachment mechanism of the adapter has a plurality of opposing engagement means for slidably receiving a slidable type mechanism of one of the plurality of mop handles. The fourth attachment mechanism of the adapter has a central threaded opening for securely receiving a threadable type mechanism of one of the plurality of mop handles.

The universal adapter along with the sponge mop head assembly can accommodate a plurality of mop handles to form a complete cleaning apparatus which includes a sponge mop head and one of the plurality of mop handles.

The sponge mop head assembly includes a plastic brace which retains a sponge mop head for cleaning a surface. The plastic brace has an attachment means for operative attachment in a simple manner to the universal adapter.

It is an object of the present invention to provide a universal adapter for adapting a sponge mop head assembly to a wide variety of conventional mop handles.

It is also an object of the present invention to provide a universal adapter to be used in conjunction with a sponge mop head assembly with the capability of changing to different types of conventional mop handles.

It is an additional object of the present invention to provide a universal adapter that can be attached to a wide variety of surfaces.

It is a further object of the preset invention to provide a universal adapter that is easily detachable or attachable.

It is still a further object of the present invention to provide a universal adapter which is not easily dislodged, but can be easily removable.

It is another object of the present invention to provide a universal adapter that is easily manufactured.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
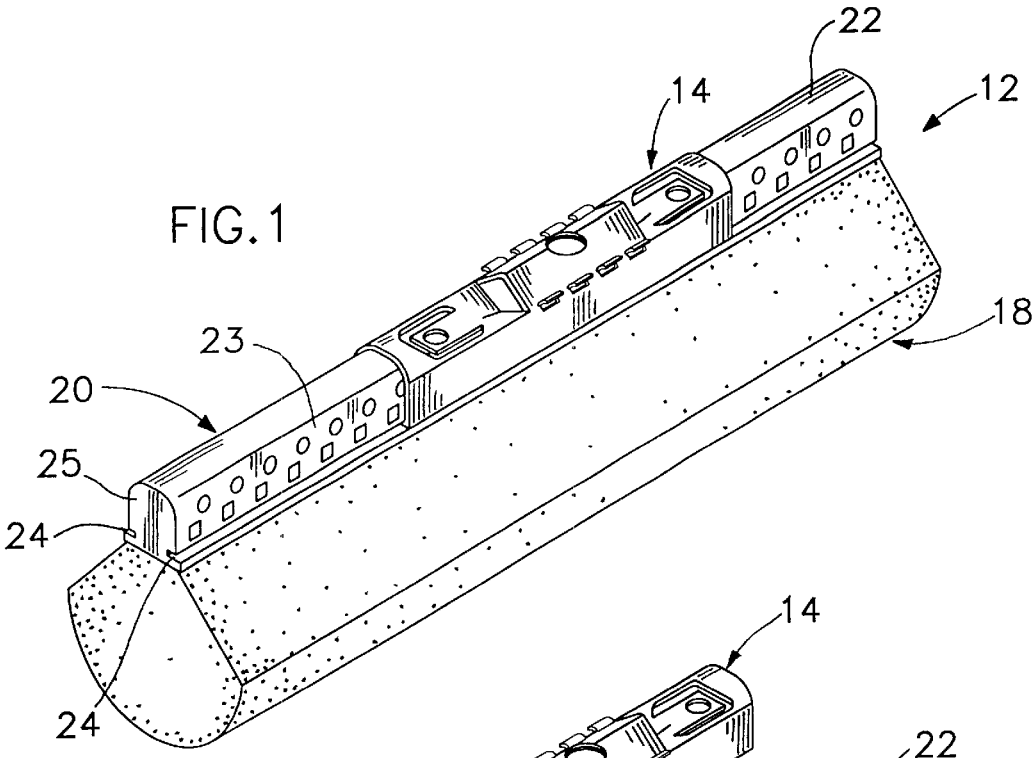
FIG. 1 is a perspective view of the present invention universal adapter attached to a sponge mop head assembly for adapting to a plurality of different types of mop handles.
Figure 2:
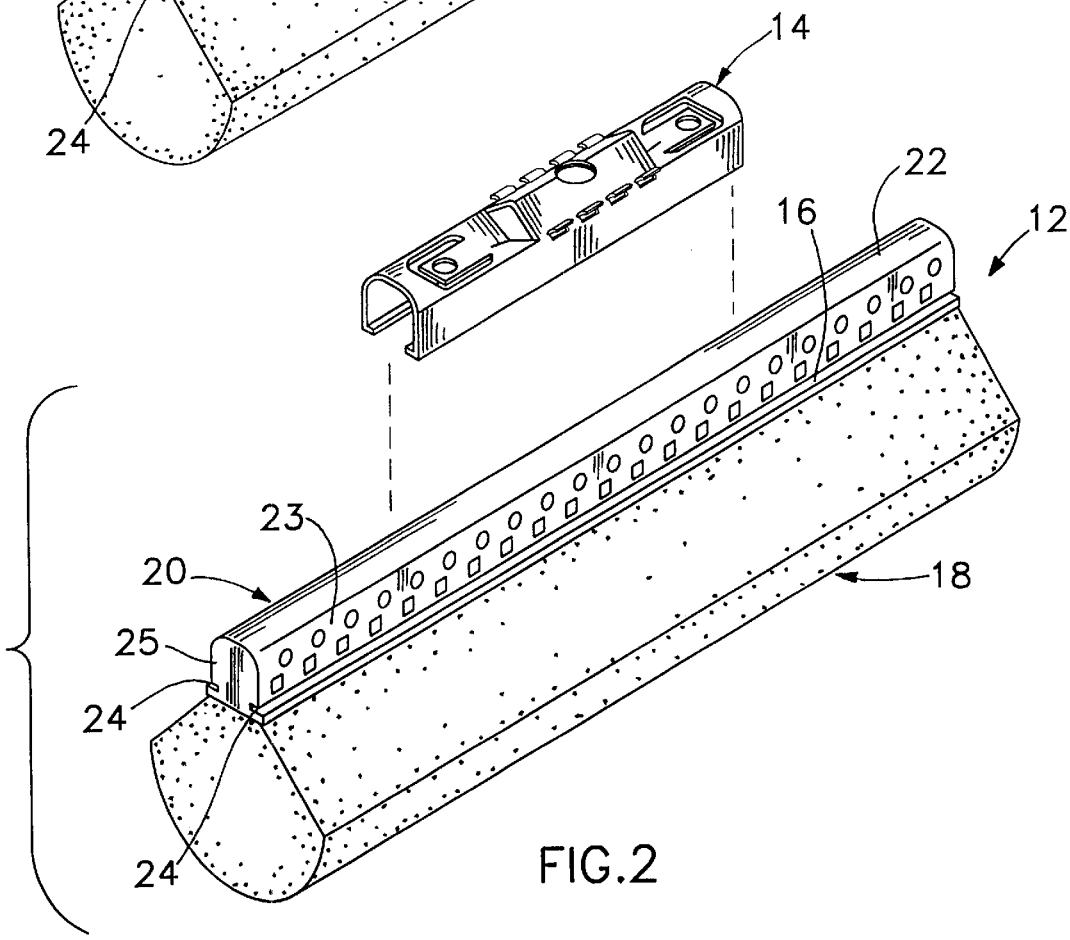
FIG. 2 is an exploded perspective view of the present invention universal adapter to be used in conjunction a sponge mop head assembly.

Referring to FIGS. 1 and 2, there is shown at 14 the present invention universal adapter to be used in conjunction with a sponge mop head assembly 12, which can be adapted to a plurality of conventional mop handles shown in FIGS. 5 through 8.

The sponge mop head assembly 12 is replaceable and includes a sponge head 18 which can be of a suitable absorbent resilient material, such as a regenerated cellulose sponge, and a brace 20 which may be made out of plastic material. The plastic brace 20 includes a top wall 22, two opposing sidewalls 23 and two opposing end walls 25. The sidewalls 23 and end walls 25 extend downwardly from the top wall 22 to form a hollow for receiving a portion of the sponge 18 therein. The plastic brace 20 further has a pair of opposite longitudinal mounting grooves 24 formed on the exterior surface of the sidewalls 23. A boss 16 is integrally formed on one of the longitudinal grooves 24 for preventing the sponge mop head assembly 12 from sliding out on its own from the universal adapter 14.

Figure 3:
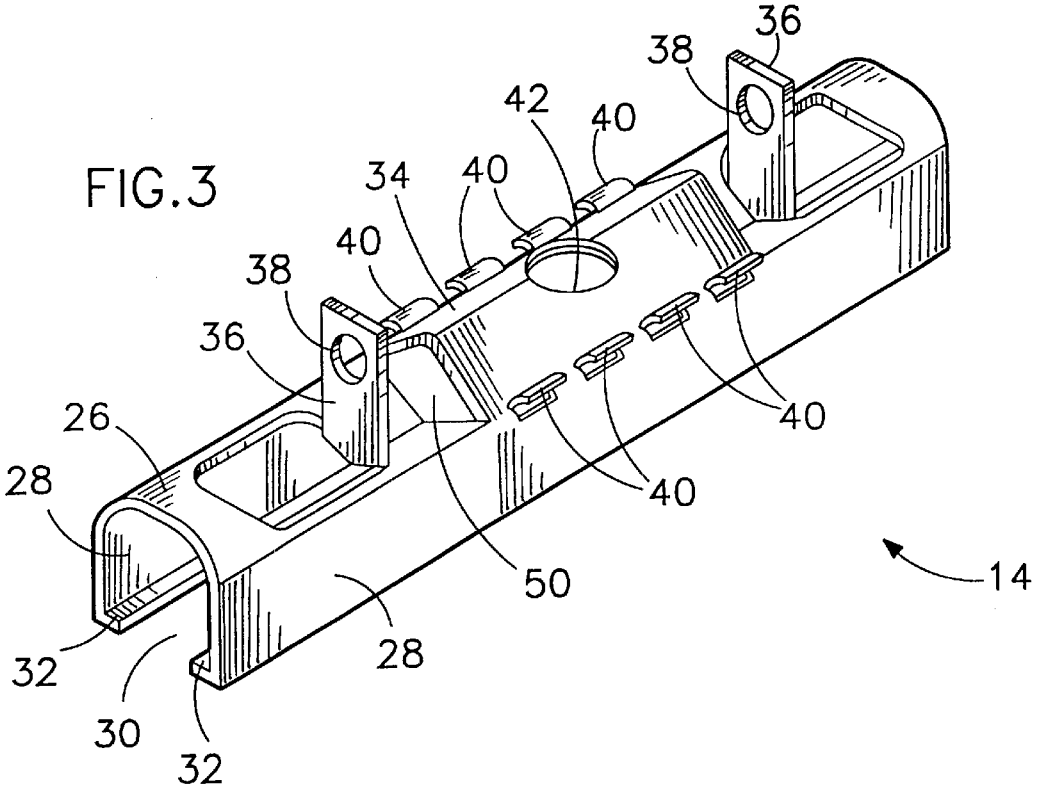
FIG. 3 is an enlarged perspective view of the present invention universal adapter, showing a pair of bendable flanges in its erect position.
Figure 4:
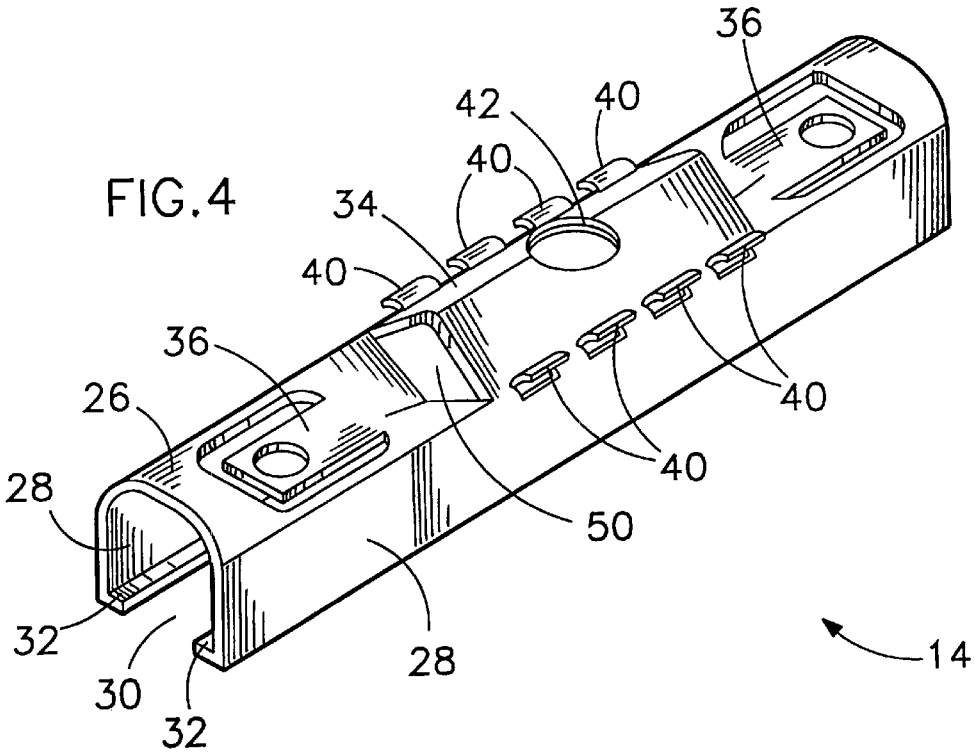
FIG. 4 is an enlarged perspective view of the present invention universal adapter, showing a pair of bendable flanges in its horizontal position.

Referring to FIGS. 3 and 4, the universal adapter 14 includes a slightly curved top wall 26 and two opposing sidewalls 28 which extend downwardly from the top wall 26 to form a hollow body 30 for receiving the plastic brace 20. Each sidewall 28 has a horizontal rail 32 which extends inwardly toward each other, where the rails 32 slidably engage into the transverse mounting grooves 24 of the brace 20 of the sponge mop head assembly 12 (see FIGS. 1 and 2).

Figure 5:
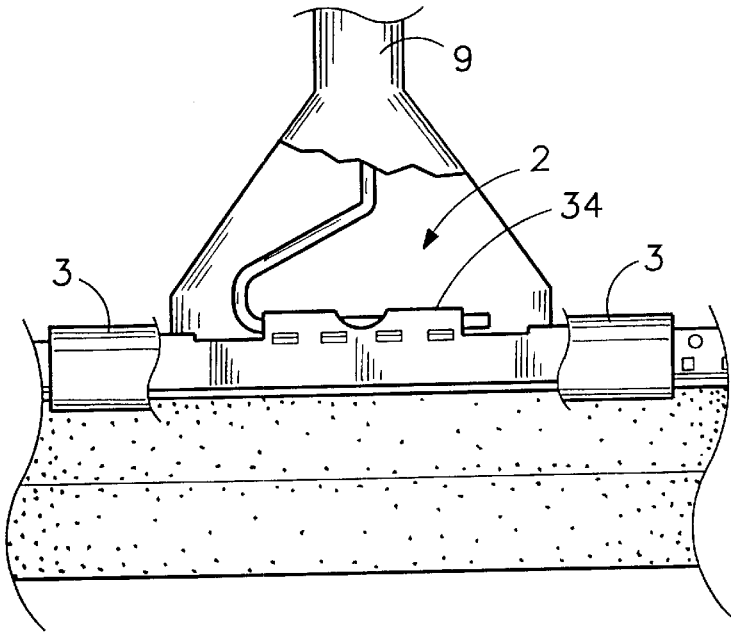
FIG. 5 is an illustration of the universal adapter attached to the sponge mop head assembly, showing the universal adapter adapted to a hook-type attachment of a conventional mop handle.
Figure 6:
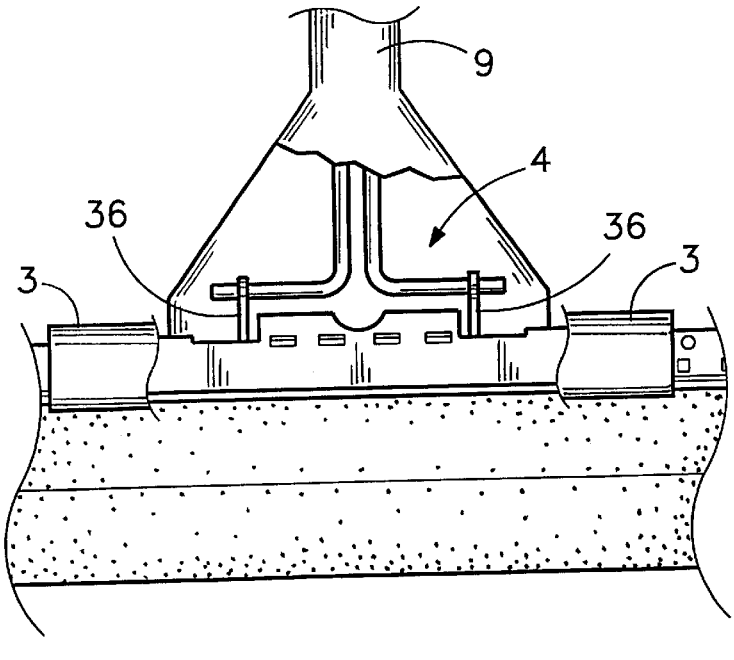
FIG. 6 is an illustration of the universal adapter attached to the sponge mop head assembly, showing the universal adapter adapted to a tongue and groove type attachment of a conventional mop handle.
Figure 7:
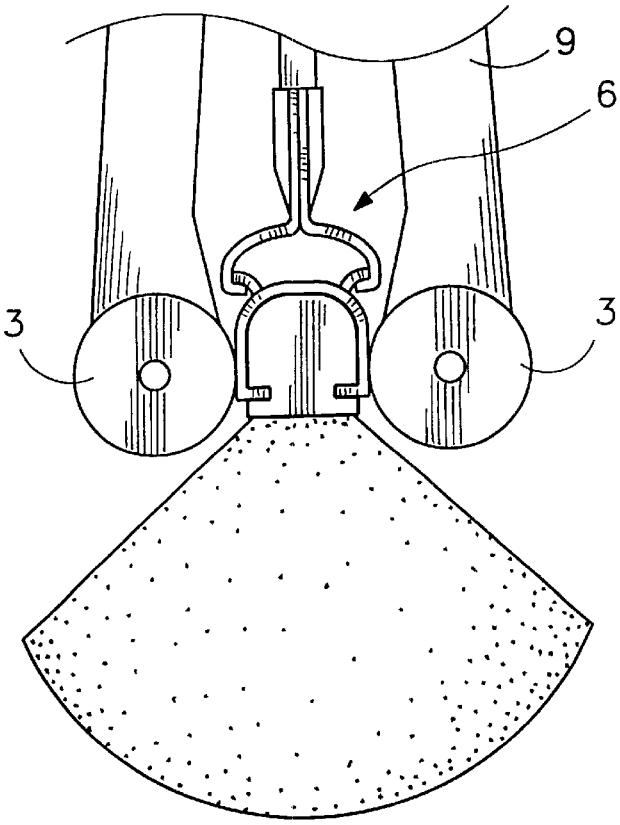
FIG. 7 is an illustration of the universal adapter attached to the sponge mop head assembly, showing the universal adapter adapted to a sliding type attachment of a conventional handle.
Figure 8:
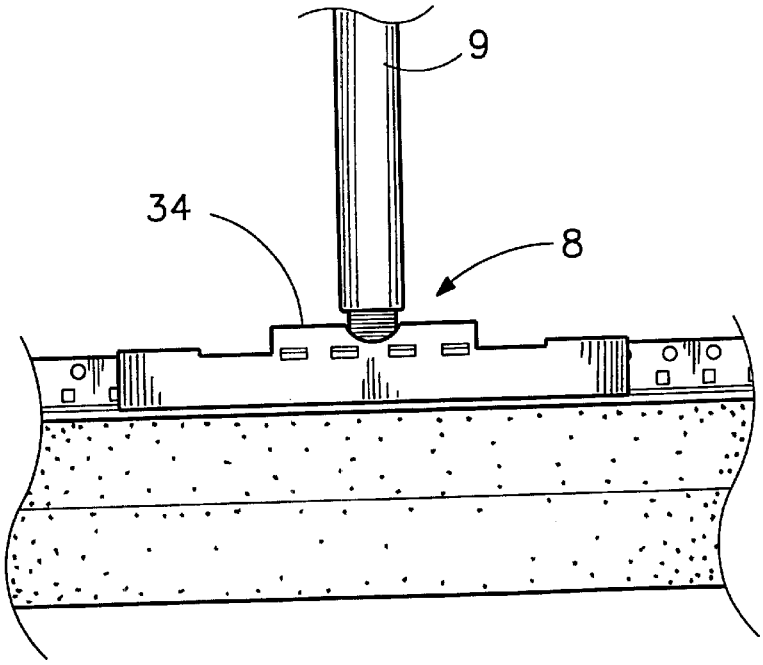
FIG. 8 is an illustration of the universal adapter attached to the sponge mop head assembly, showing the universal adapter adapted to a threadable type attachment of a conventional mop handle.

The top wall 26 of the universal adapter 14 comprises a central hook catch section 34 which protrudes upwardly away from the top wall 26 to form a transverse opening 50 for securely receiving a hook type attachment 2 of one type of a plurality of handles 9, where the opposing rollers 3 of the handle 9 are located adjacent to the brace 20 of the sponge mop head assembly (see FIGS. 5 and 7). The central hook catch section 34 has a longitudinal central threaded aperture 42 for accommodating a threaded type attachment 8 of another type of the plurality of handle 9 (see FIG. 8).

The top wall 26 of the universal adapter 14 further comprises a pair of opposing bendable flanges 36. FIG. 3 shows the pair of bendable flanges 36 which face each other in its erect or engagement position while FIG. 4 shows the pair of bendable flanges 36 in a horizontal or non-engagement position. Therefore, the pair of bendable flanges 36 are in the horizontal position when not in use. Each bendable flange 36 has an opening 38 which extends therethrough for securely receiving a tongue and groove type attachment 4 of another type of the plurality of handles 9, where the opposing rollers 3 of the handle 9 are located adjacent to the brace 20 (see FIG. 6).

The universal adapter 14 further comprises a plurality of spaced apart opposing engagement flanges or tips 40 which extend outwardly away from the sidewalls 28 and located adjacent to the two walls 26. These flanges 40 slidably receive a sliding type attachment 6 of another type of the plurality of handles 9, where the opposing rollers 3 of the handle 9 are located on the sidewalls 28 of the adapter 14 (see FIG. 7).

The present invention universal adapter 14 allows the sponge mop head assembly 12 to accommodate a plurality of different mop handles 9 to form a complete cleaning apparatus which includes the sponge mop head assembly 12, the universal adapter 14 and any one of the plurality of handles 9 (shown in FIGS. 5 through 8).

The universal adapter 14 can be made from several materials. By way of example, the universal adapter 14 can be made of metal material or any other suitable material.

Defined in detail, the present invention is a universal adapter for adapting a sponge mop head assembly to a plurality of different types of mop handles, the sponge mop head assembly having a sponge head and a brace member which retains the sponge head thereto, the brace member having a pair of transverse mounting grooves located on opposite exterior sides, the universal adapter comprising: (a) a body having a top wall and two opposing sidewalls extending downwardly from the top wall to form a hollow for receiving the brace member of the sponge mop head assembly, each sidewall having a rail extending inwardly toward each other, where the rails are respectively slidably engaged into a respective one of the pair of transverse mounting grooves of the brace member of the sponge mop head assembly; (b) the top wall of the hollow body further including a central hook catch section which protrudes upwardly therefrom to form a transverse opening for securely receiving a hook type attachment of one of the plurality of different types of mop handles; (c) the top wall of the hollow body further including a longitudinal central threaded aperture located on the hook catch section for securely receiving a threadable type attachment of one of the plurality of different types of mop handles; (d) the top wall of the hollow body further including a pair of opposing bendable flanges which are bent upwardly to an erect position and are facing each other, each bendable flange having an aperture for securely receiving a tongue and groove type attachment of one of the plurality of different types of mop handles; and (e) a plurality of spaced apart opposing engagement flanges extending outwardly from the two opposing sidewalls of the hollow body and located adjacent to the top wall for slidably receiving a sliding type attachment of one of the plurality of different types of mop handles; (f) whereby the hollow body of the universal adapter adapts the sponge mop head assembly to the plurality of different types of mop handles to form a complete cleaning apparatus.

Defined broadly, the present invention is a universal adapter for adapting a sponge mop head assembly to a plurality of different types of handles, the sponge mop head assembly having a sponge head and a brace which retains the sponge head thereto, the brace having at least two grooves located on opposite exterior sides, the universal adapter comprising: (a) a body having a top wall and two sidewalls extending downwardly from the top wall to form a hollow for receiving the brace, each sidewall having a rail extending inwardly toward each other, where the rails are respectively slidably engaged into a respective one of the at least two grooves of the brace of the sponge mop head assembly; (b) the top wall of the body further including a hook catch section which protrudes upwardly therefrom to form an opening for securely receiving a hook type attachment of one of the plurality of different types of handles; (c) the top wall of the body further including a threaded aperture located on the hook catch section for securely receiving a threadable type attachment of one of the plurality of different types of handles; (d) the top wall of the body further including a pair of bendable flanges which are bent upwardly to an erect position and are facing each other, each bendable flange having an aperture for securely receiving a tongue and groove type attachment of one of the plurality of different types of handles; and (e) a plurality of engagement flanges extending outwardly from the two sidewalls of the body for slidably receiving a sliding type attachment of one of the plurality of different types of handles; (f) whereby the body of the universal adapter adapts the sponge mop head assembly to the plurality of different types of handles to form a complete cleaning apparatus.

Defined more broadly, the present invention is an adapter for adapting a cleaning head assembly to a plurality of different types of handles, the cleaning head assembly having a cleaning head and a brace which retains the cleaning head thereto, the brace having at least one groove, the adapter comprising: (a) a body for receiving the brace and having at least one rail for slidably engaging into the at least one groove of the brace of the cleaning head assembly; (b) the body further including a hook catch section for securely receiving a hook type attachment of one of the plurality of different types of handles; (c) the body further including a threaded aperture located on the hook catch section for securely receiving a threadable type attachment of one of the plurality of different types of handles; (d) the body further including at least two flanges which are bent upwardly to an erect position and are facing each other for securely receiving a tongue and groove type attachment of one of the plurality of different types of handles; and (e) a plurality of flanges extending outwardly from the body for slidably receiving a sliding type attachment of one of the plurality of different types of handles; (f) whereby the body of the adapter adapts the cleaning head assembly to the plurality of different types of handles to form a complete cleaning apparatus.

Defined even more broadly, the present invention is an adapter for adapting a cleaning head assembly to a plurality of different types of handles, the cleaning head assembly having a cleaning head and a brace which retains the cleaning head thereto, the brace having at least one groove, the adapter comprising means for receiving the brace of the cleaning head assembly and having at least one rail for slidably engaging into the at least one groove of the brace of the cleaning head assembly, the adapter further having means for securely receiving the plurality of different types of handles, whereby the adapter adapts the cleaning head assembly to the plurality of different types of handles to form a complete cleaning apparatus.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A universal adapter for adapting a sponge mop head assembly to a plurality of different types of mop handles, the sponge mop head assembly having a sponge head and a brace member which retains the sponge head thereto, the brace member having a pair of transverse mounting grooves located on opposite exterior sides, the universal adapter comprising:

a. a body having a top wall and two opposing sidewalls extending downwardly from the top wall to form a hollow for receiving said brace member of said sponge mop head assembly, each sidewall having a rail extending inwardly toward each other, where the rails are respectively slidably engaged into the respective one of said pair of transverse mounting grooves of said brace member of said sponge mop head assembly;

b. said top wall of said hollow body further including a central hook catch section which protrudes upwardly therefrom to form a transverse opening for securely receiving a hook type attachment of one of said plurality of different types of mop handles;

c. said top wall of said hollow body further including a longitudinal central threaded aperture located on said hook catch section for securely receiving a threadable type attachment of one of said plurality of different types of mop handles;

d. said top wall of said hollow body further including a pair of opposing bendable flanges which are bent upwardly to an erect position and are facing each other, each bendable flange having an aperture for securely receiving a tongue and groove type attachment of one of said plurality of different types of mop handles; and e. a plurality of spaced apart opposing engagement flanges extending outwardly from said two opposing sidewalls of said hollow body and located adjacent to said top wall for slidably receiving a sliding type attachment of one of said plurality of different types of mop handles;

f. whereby said hollow body of said universal adapter adapts said sponge mop head assembly to said plurality of different types of mop handles to form a complete cleaning apparatus.

2. The universal adapter in accordance with claim 1, wherein said hollow body is made of metal material.

3. A universal adapter for adapting a sponge mop head assembly to a plurality of different types of handles, the sponge mop head assembly having a sponge head and a brace which retains the sponge head thereto, the brace having at least two grooves located on opposite exterior sides, the universal adapter comprising:

a. a body having a top wall and two sidewalls extending downwardly from the top wall to form a hollow for receiving said brace, each sidewall having a rail extending inwardly toward each other, where the rails are respectively slidably engaged into a respective one of said at least two grooves of said brace of said sponge mop head assembly;

b. said top wall of said body further including a hook catch section which protrudes upwardly therefrom to form an opening for securely receiving a hook type attachment of one of said plurality of different types of handles;

c. said top wall of said body further including a threaded aperture located on said hook catch section for securely receiving a threadable type attachment of one of said plurality of different types of handles;

d. said top wall of said body further including a pair of bendable flanges which are bent upwardly to an erect position and are facing each other, each bendable flange having an aperture for securely receiving a tongue and groove type attachment of one of said plurality of different types of handles; and e. a plurality of engagement flanges extending outwardly from said two sidewalls of said body for slidably receiving a sliding type attachment of one of said plurality of different types of handles;

f. whereby said body of said universal adapter adapts said sponge mop head assembly to said plurality of different types of handles to form a complete cleaning apparatus.

4. The universal adapter in accordance with claim 3, wherein said body is made of metal material.

5. An adapter for adapting a cleaning head assembly to a plurality of different types of handles, the cleaning head assembly having a cleaning head and a brace which retains the cleaning head thereto, the brace having at least one groove, the adapter comprising:

a. a body for receiving said brace and having at least one rail for slidably engaging into said at least one groove of said brace of said cleaning head assembly;

b. said body further including a hook catch section for securely receiving a hook type attachment of one of said plurality of different types of handles;

c. said body further including a threaded aperture located on said hook catch section for securely receiving a threadable type attachment of one of said plurality of different types of handles;

d. said body further including at least two flanges which are bent upwardly to an erect position and are facing each other for securely receiving a tongue and groove type attachment of one of said plurality of different types of handles; and e. a plurality of flanges extending outwardly from said body for slidably receiving a sliding type attachment of one of said plurality of different types of handles;

f. whereby said body of said adapter adapts said cleaning head assembly to said plurality of different types of handles to form a complete cleaning apparatus.

6. The adapter in accordance with claim 5, wherein said body is made of metal material.

7. An adapter for adapting a cleaning head assembly to a plurality of different types of handles, the cleaning head assembly having a cleaning head and a brace which retains the cleaning head thereto, the brace having at least one groove, the adapter comprising means for receiving the brace of the cleaning head assembly and having at least one rail for slidably engaging into the at least one groove of the brace of the cleaning head assembly, the adapter further having means for securely receiving said plurality of different types of handles, whereby the adapter adapts the cleaning head assembly to the plurality of different types of handles to form a complete cleaning apparatus.

8. The adapter in accordance with claim 7, wherein said adapter is made of metal material.

9. The adapter in accordance with claim 7, wherein said means for securely receiving said plurality of different types of handles includes a plurality of engagement flanges extending outwardly from said adapter for slidably receiving a sliding type attachment of one of said plurality of different types of handles.

10. The adapter in accordance with claim 7, wherein said means for securely receiving said plurality of different types of handles includes a hook catch section for securely receiving a hook type attachment of one of said plurality of different types of handles.

11. The adapter in accordance with claim 10, wherein said means for securely receiving said plurality of different types of handles includes a threaded aperture located on said hook catch section for securely receiving a threadable type attachment of one of said plurality of different types of handles.

12. The adapter in accordance with claim 7, wherein said means for securely receiving said plurality of different types of handles includes at least two flanges which are bent upwardly to an erect position and are facing each other for securely receiving a tongue and groove type attachment of one of said plurality of different types of handles.

* * * * *